US010729220B2

(12) United States Patent
Im et al.

(10) Patent No.: US 10,729,220 B2
(45) Date of Patent: Aug. 4, 2020

(54) ELECTRIC NAIL FILING DEVICE WITH SAFETY GUARD CAP

(71) Applicants: Jun Su Im, Troy, MI (US); Young Ki Kim, Rochester, MI (US)

(72) Inventors: Jun Su Im, Troy, MI (US); Young Ki Kim, Rochester, MI (US)

( * ) Notice: Subject to any disclaimer, the term of this patent is extended or adjusted under 35 U.S.C. 154(b) by 519 days.

(21) Appl. No.: 15/607,613

(22) Filed: May 29, 2017

(65) Prior Publication Data

US 2018/0338597 A1 Nov. 29, 2018

(51) Int. Cl.

| | |
|---|---|
| ***A45D 29/05*** | (2006.01) |
| ***A45D 29/04*** | (2006.01) |
| *A45D 29/00* | (2006.01) |

(52) U.S. Cl.

CPC ..... *A45D 29/05* (2013.01); *A45D 29/04* (2013.01); *A45D 2029/008* (2013.01)

(58) Field of Classification Search

CPC ..... A45D 29/00; A45D 29/05; A45D 29/06; A45D 29/11; A45D 29/14; A01K 13/00

See application file for complete search history.

(56) References Cited

U.S. PATENT DOCUMENTS

| | | | | |
|---|---|---|---|---|
| 4,683,897 | A | 8/1987 | McBride | |
| 4,753,253 | A | 6/1988 | Hutson | |
| 5,161,552 | A | 11/1992 | Kathuria | |
| 6,640,811 | B2 | 11/2003 | Cho | |
| 7,428,881 | B2 | 9/2008 | Drelinger | |
| 7,500,486 | B2 | 3/2009 | Gilg | |
| 2007/0089686 | A1 * | 4/2007 | Drelinger | A01K 13/00 119/609 |
| 2011/0226270 | A1 | 9/2011 | Rivera | |
| 2015/0150353 | A1 | 6/2015 | Yiu | |
| 2016/0029768 | A1 | 2/2016 | Dai | |

FOREIGN PATENT DOCUMENTS

WO WO 2017/025776 * 2/2017

* cited by examiner

*Primary Examiner* — Rachel R Steitz

(57) ABSTRACT

An electric nail filing device includes a cylindrical body having a battery holder attached inside in the body, a cover attached to an open end of the cylindrical body, an on/off switch attached on the cover or the cylindrical body, an electric motor having a metallic rotary filing wheel, and a safety guard cap attached and covering the wheel, shaped like a rectangular prism, a pentagonal prism, a hexagonal prism, or a multiplane prism having multiple planes and a tubular cylindrical housing inner space which has enough space to cover the wheel, in which the safety guard cap has multiple slots on the planes, and an adjustable guard tab attached at closed end of the safety guard cap. Optionally the safety guard cap is covered by a nail debris collector which is shaped like a half-dome covering all other planes of the safety guard cap except one plane.

4 Claims, 8 Drawing Sheets

ELECTRIC NAIL FILING DEVICE WITH SAFETY GUARD CAP

BACKGROUND OF THE INVENTION

Field of the Invention

While several prior art of nail trimming devices disclose the general concept of protective nail guards associated with powered rotating nail trimming devices, none of the devices of such prior arts permit filing or smoothing of rough finger nails or toenails, even with those with substantial curvature, without fear of damage to the adjacent skin. To make nail filing enjoyable, the present invention is equipped with a specially designed nail guard cap and permanent nail filing member that is safe to skin and sanitizable for users having various kind of finger nail or toe nail shape. The invention, for example, provides a safety guard cap structure for the user, particularly for an elder person who has various kind of toenail such as concave or convex nail tip or has bigger and longer toe skin for the toenail. Present invention will provide a safe, easy to use, and multifunctional motorized nail-trimming device.

Description of Related Art Including Information Disclosed

The prior art is an electric nail filing device with a protective skin guard. An example is the U.S. Pat. No. 4,683,897 issued to McBride which provides an electric rotary nail file device with a protective skin guard and gives a guard structure shielding the skin adjacent the nail form damages by the rotating member when the device is in use.

The U.S. Pat. No. 5,161,552 issued to Kathuria provides an electrical nail file device with cylindrical housing having multiple slots on the housing and file drum with formed annular valleys for the purpose of filing nails of longer length.

And the U.S. Pat. No. 7,428,881 issued to Drelinger provides a rotary nail filing device for animals which has an electric rotary file and cover with suitable sized and shaped holes to allow an end portion of an animal's nail.

BRIEF SUMMARY OF THE INVENTION

Present invention is to provide a safe, easy to use, sanitizable, and multifunctional motorized nail trimming devices especially a safety guard cap.

Object of the present invention is to provide a multifunctional safety guard cap for a rotary nail filing device, which permits ready access to all parts of the end tip of a finger nail or toenail, regardless of the shape, curvature or size, without fear of damaging the delicate skin around the nails. Present invention provides a safety guard cap having an adjustable guard tab with which user operates this device preventing the rotary nail filing device from touching and damaging adjacent skin. The adjustable guard tab attached at the closed end of the safety guard cap controls the user to adjust the guard tab up or down depending on the shape of the user's fingertip or toe tip. It is still another object of the present invention to provide a DC electric power sourced or battery power sourced finger nail or toenail filing device shaped to permit easy handling during operation, easy sanitization, and convenient storability. These and other objects of the present invention are accomplished through the use of a specially chosen alloy and designed rotatable filing member. These and other objects, features and advantages of the present invention will become apparent to those skilled in the art from reading of the following detailed description of embodiments constructed in accordance, in conjunction with the accompanying drawings and simulation drawings.

DETAILED DESCRIPTION OF THE INVENTION

Figure 1:
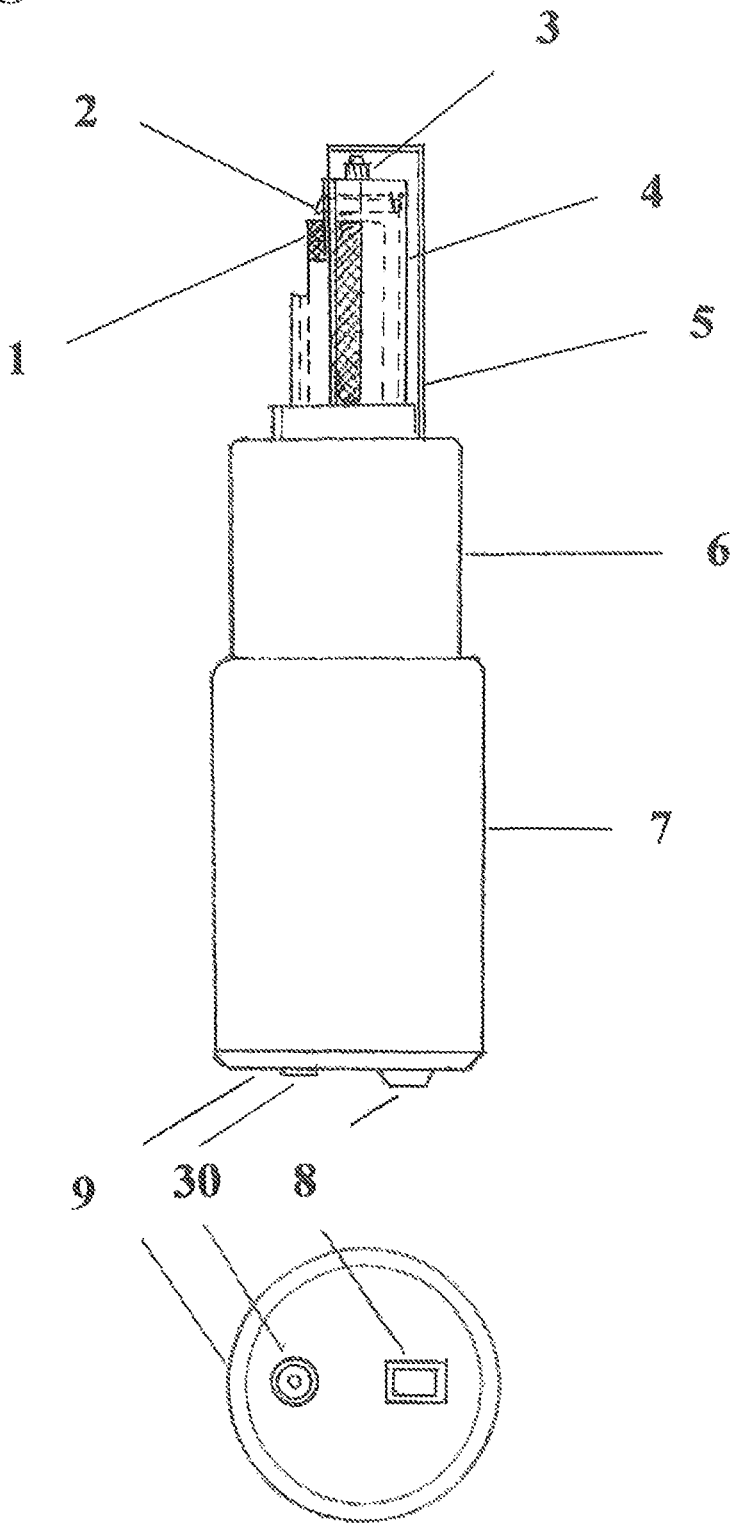
FIG. 1 is a perspective view of an electric nail filing device with safety guard cap of the present invention. 1 is a metallic rotary filing wheel which is minimum 0.5 cm to maximum 10 cm length. 2 is an adjustable guard tab. 3 is a turning knob. 4 is a safety guard cap of the present invention. 5 is a rotatable and detachable optional nail debris collector. 6 is a compartment for an electric motor. 7 is a body. 8 is an on/off switch for the motor. 9 is a cover for the motor and battery compartment. 30 is DC voltage input plug in hole.
Figure 2:
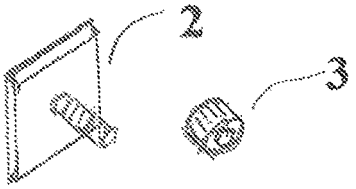
FIG. 2 is a close-up perspective view of the exemplified the safety guard cap 4 and head portion of the device of the present invention. Each longitudinal slot will have different with thickness to provide the depth as required for a different nail length filing. 13*a* and 14*a* illustrate two different methods of filing of fingernail or toenail while using an embodiment of the present invention. The safety guard cap 4 has multiple longitudinal slots on its surface, and each slot has different width and depth of nail filing guide. Maximum slot's thickness is 5 mm. The width of filing slot will be between 1 mm to 5 mm. 10 is an example of a slot for short nail filing. 11 is an example of a slot for long nail filing. 12 is an example of a slot for longer nail filing. 13 is an example of a slot with longitudinal cove shape groove. As shown on drawing filing different length nail is achieved by choosing a right depth longitudinal slot of the flat nail guard. 14 is a dynamic nail length filing area controlled by the adjustable guard tab 2 and the turning knob 3. The dynamic nail length filing area 14 is not covered and open space of the safety guard cap 4, in which dimension is minimum 2 mm in length, 5 mm in width, and 2 mm in depth. It also used for filing a nail edge and touch up area. The gap between the outer surface of the metallic rotary filing wheel 1 and the inner surface of the safety guard cap 4 is not greater than 2 mm.
Figure 2:
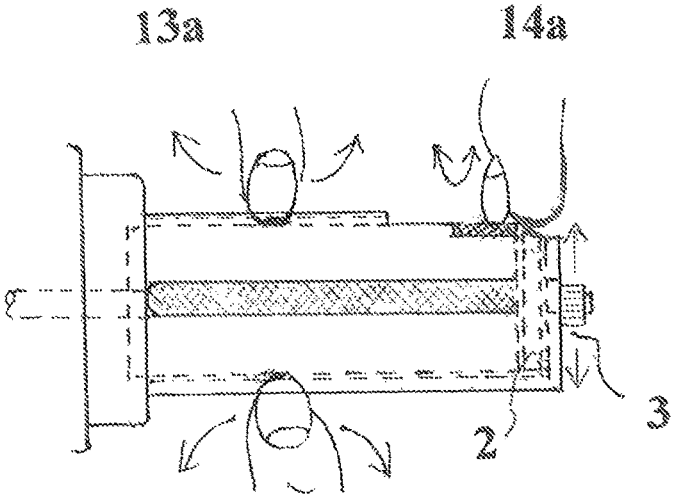
Figure 2:
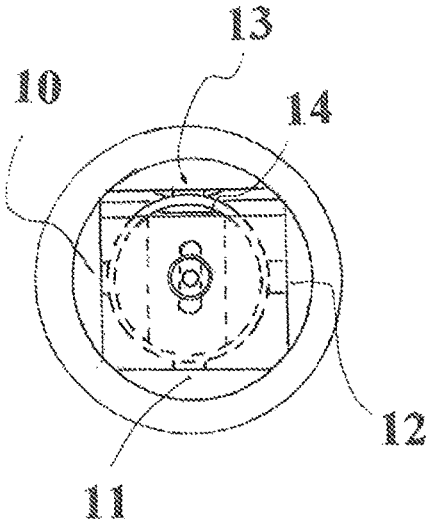
Figure 2A:
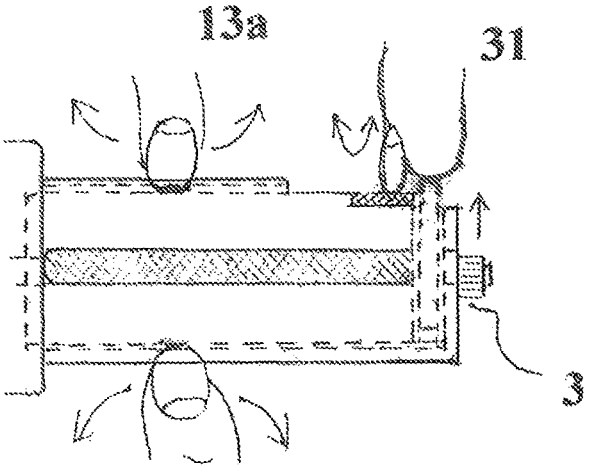
FIG. 2A is a close-up position of the adjustable guard tab for longer nail filing 31
Figure 2B:
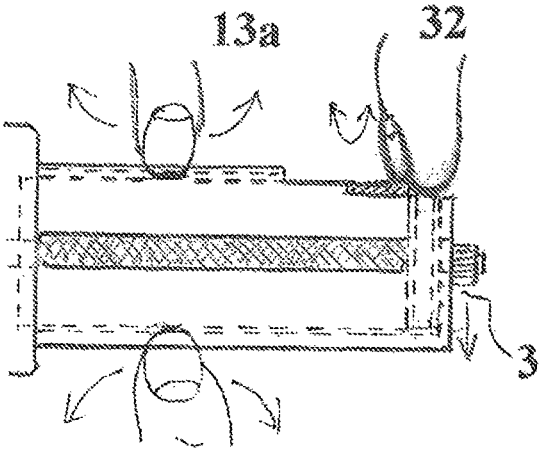
FIG. 2B is a close-up position of the adjustable guard tab for shorter nail filing 32

This invention is described by embodiment of the detailed description set forth below. The present invention provides, in a preferred embodiment of this invention, an electric nail filing device with a safety guard cap 4 comprising a cylindrical body 7 made of hard casing material, such as aluminum or plastic, having a battery holder attached inside in the cylindrical body 7, a cover 9 attaching and detaching to an open end of the cylindrical body 7, an on/off switch 8 and DC voltage input plug 30 attached on the cover 9 in order to control electric power between the battery holder and an electric motor 6, the electric motor 6 attached on an opposing end of the cylindrical body 7 having a metallic rotary filing wheel 1, which is made of a cylindrical metal and alloy of bronze, brass, stainless steel, aluminum, or copper, including all metal and oxide form of any metal and alloy, and the safety guard cap 4 which is attachable or detachable with the electric motor 6 and covering the metallic rotary filing wheel 1, preferably which is a rectangular prism shape, but not limited to the rectangular prism, having multiple planes and a tubular cylindrical housing inner space which has enough space to cover the metallic rotary filing wheel 1. The safety guard cap 4 has one filing slot on each surface of the multiple planes and an adjustable guard tab 2 attached at closed end of the safety guard cap 4. The adjustable guard tab 2 is attached inside the closed end surface of the safety guard cap 4 orthogonal to the longitudinal axis of the safety guard cap. Loosening of turning knob 3 will allow sliding up or down of the adjustable guard tab 2 for right height depending on a user's length of nail or finger/toe shape and tightening of turning knob 3 will stop the movement of adjustable guard tab 2.

For more effective and easy filing, instead of flat shaped multiple planes, to accept, receive, and filing a fingernail or toenail at least one plane of the safety guard cap has a pair of longitudinal cove grooves on the plane and a slot on the center line between two cove grooves where top circular surface of the metallic wheel slightly elevated above lowest cove surface. To help applying and filing different size of finger nails or toe nails an alternative shape of the longitudinal cone shape configuration formed by a pair of longitudinal cove shape groove which has a narrow cove shape groove on one end for small nail filing and gradual widening of cove shape groove to the opposite end for large nail filing with a longitudinal nail filing grove in the middle.

The adjustable guard tab member comprises preferably a movable adjustable guard tab 2 which is a square-flat plate having a threaded bolt attached orthogonally on the adjustable guard tab 2, a slot on the surface of the closed end of the safety guard cap 4, and a turning knob 3. The adjustable guard tab 2 with threaded bolt is secured to the slot on the closed end of safety guard cap 4 by turning knob 3. Loosening knob 3 and sliding up or down of the adjustable guard tab 2 along on the slot on the closed end of safety guard cap and tightening it will allow appropriate tab height for desired length of nail filing. For the multiple planes, one plane of the multiple planes and the opposite side plane on the safety guard cap 4 is not connected to the closed end of the safety guard cab at least 5 mm to provide enough space for attaching the adjustable guard tab 2.

Further, the present invention provides a nail debris collector 6 made of hard casing material, for example metal or plastic, and a half-dome shape covering all other planes of the safety guard cap 4 except one plane which is ongoing used plane. It has an attachable member at one side of the nail debris collector 6 to attach and cover the safety guard cap 4, a closed opposing end, a cylindrical surface and an inner space between the attachable member and the closed opposing end, and a wide slit on the cylindrical surface, such that the nail debris collector covers all other slots except one slot and prevents debris of fingernail or toenail from scattering around.

One alternative design of the safety guard cap 4 is that the shape of the safety guard cap is a pentagonal prism, a hexagonal prism, or a multiplane prism having multiple planes, on which each plane has one slot having different depth. And one plane of the multiple planes on the safety guard cap 4 has one open end and one adjustable guard tab 2 at the closed end of the safety guard cap 4. Also the other alternative design is that the shape of the safety guard cap 4 is a cylindrical shape having a single plane or double planes on the surface and one adjustable guard tab 2 described above.

Figure 3:
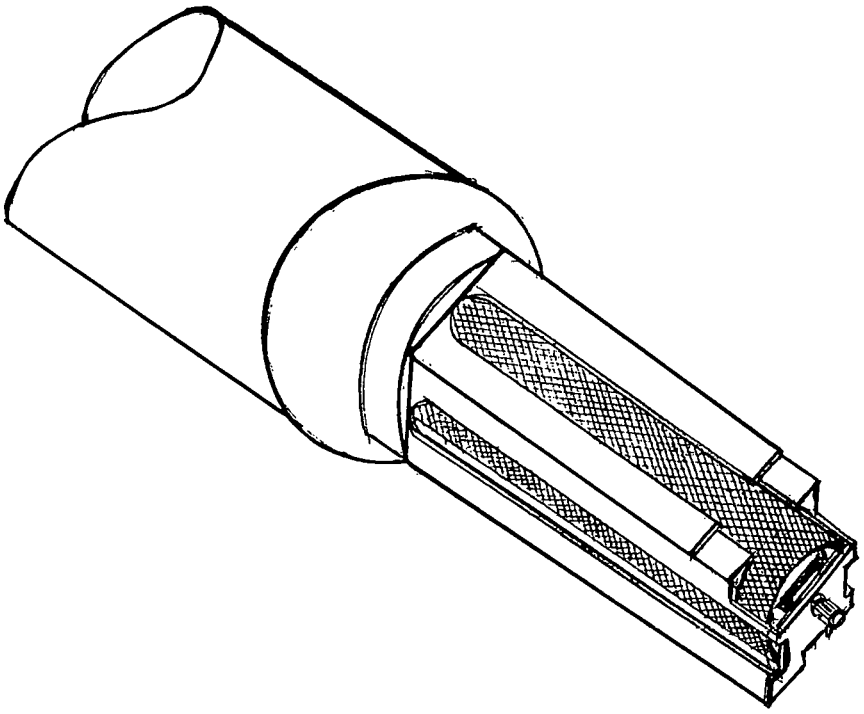
FIG. 3 is a close-up of elevational and angled perspective view of the head portion of the device of the present invention.
Figure 4:
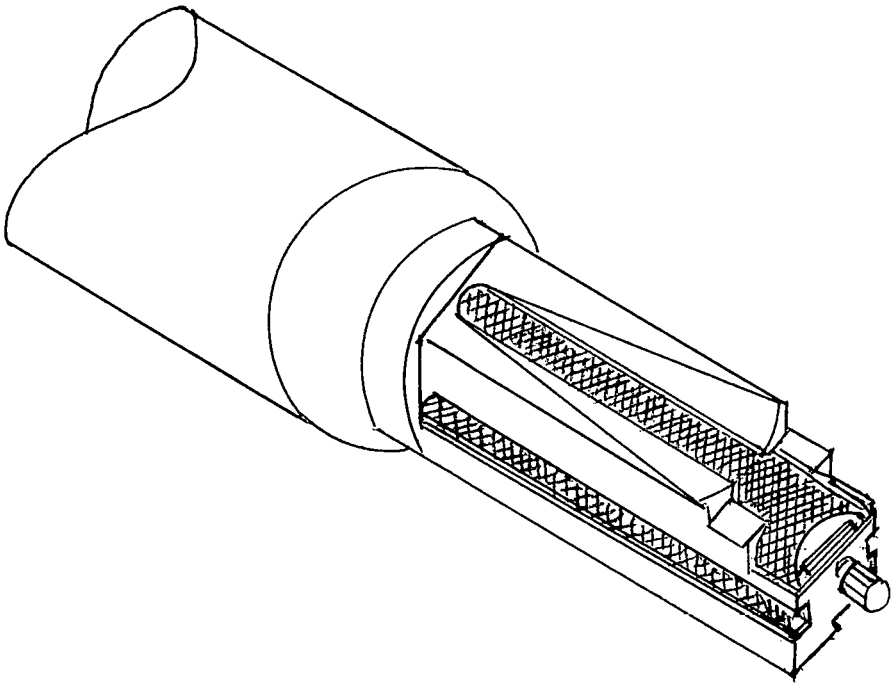
FIG. 4 is a close-up of elevational and angled perspective view of an alternative example of the head portion having a longitudinal cove shape groove with cone shape configuration on the top of the safety guard cap 4.
Figure 5:
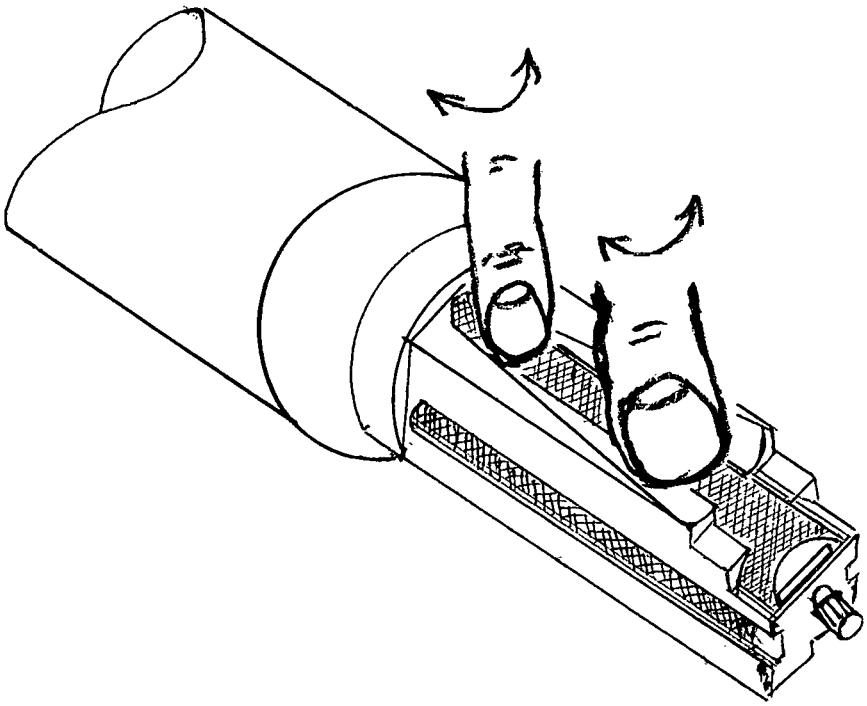
FIG. 5 is a close-up of elevational and angled perspective view illustrating various methods of filing of fingernail or toenail while using the longitudinal cove shape groove with cone groove of the present invention.
Figure 5A:
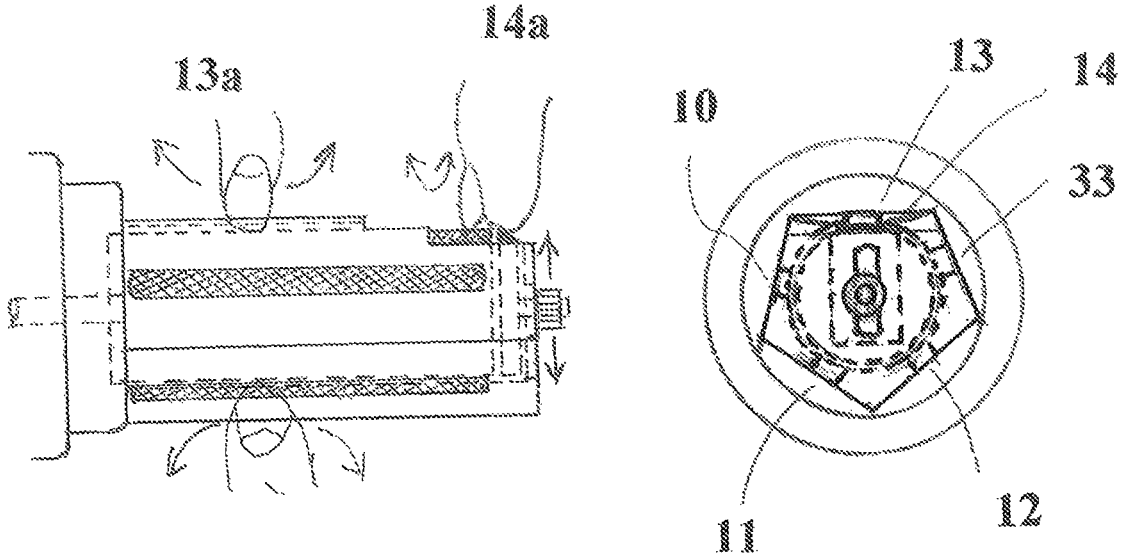
FIG. 5A is a close-up perspective view of the exemplified the safety guard cap 4 with possible 5 facet planes on head portion of the device of the present invention. Each longitudinal slot will have different wall thickness to provide the depth as required for a different nail length filing. 13*a* and 14*a* illustrate two different methods of filing of fingernail or toenail while using an embodiment of the present invention. The safety guard cap 4 has multiple longitudinal slots on its surface, and each slot has different width and depth of nail filing guide. Maximum slot's thickness is 5 mm. The width of filing slot will be between 1 mm to 5 mm. 10 is an example of a slot for short nail filing. 11 is an example of a slot for long nail filing. 12 is an example of a slot for longer nail filing. 13 is an example of a slot with longitudinal cove shape groove with cone shape configuration. As shown on drawing filing different length nail is achieved by choosing a right depth longitudinal slot of the flat nail guard. 33 is an example of a slot position for longest nail filing. 14 is a dynamic nail length filing area controlled by the adjustable guard tab 2 and the turning knob 3. The dynamic nail length filing area 14 is not covered and open space of the safety guard cap 4, in which dimension is minimum 2 mm in length, 5 mm in width, and 2 mm in depth. It also used for filing a nail edge and touch up area. The gap between the outer surface of the metallic rotary filing wheel 1 and the inner surface of the safety guard cap 4 is not greater than 2 mm.
Figure 5B:
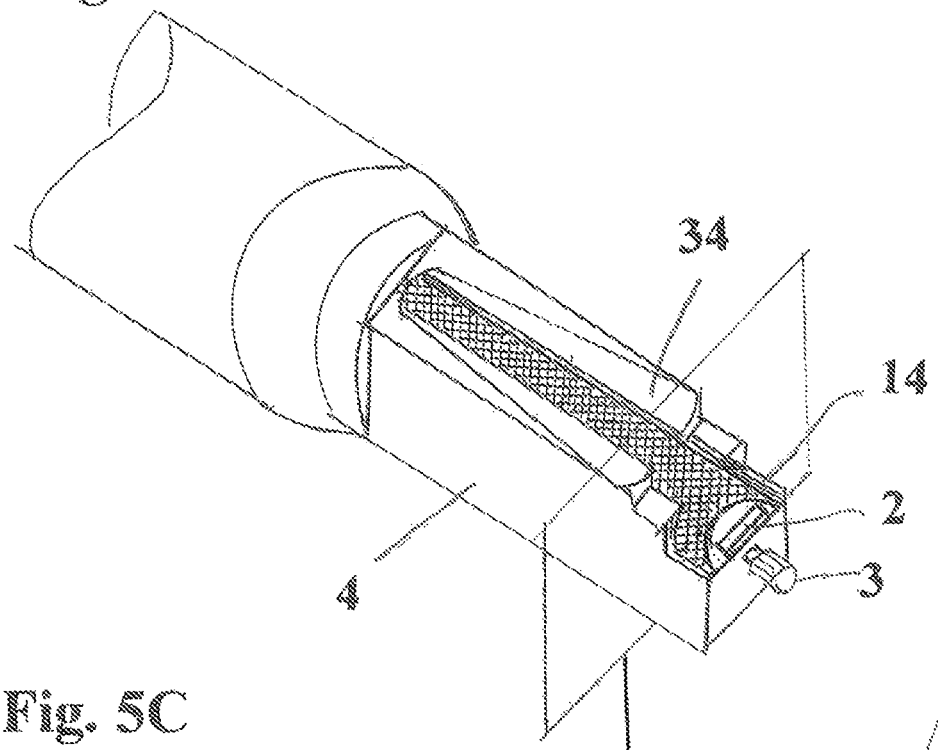
FIG. 5B is a close-up of elevated and angled perspective view of the head portion of the device having one facet plane with a pair of cove shape groove 34 on a cone shape configuration on top of the safety guard cap 4. 14 is a dynamic nail length filing area controlled by the adjustable guard tab 2 and the turning knob 3. The dynamic nail length filing area 14 is not covered and open space of the safety guard cap 4. Also shows detailed cross-sectional view of cove shape groove that will stabilize the nail-filing finger from inertial movement due to rotating abrasive nail file and rotating round top surface of abrasive wheel is slightly above the lowest cove groove surface for the efficient nail filing.
Figure 5C:
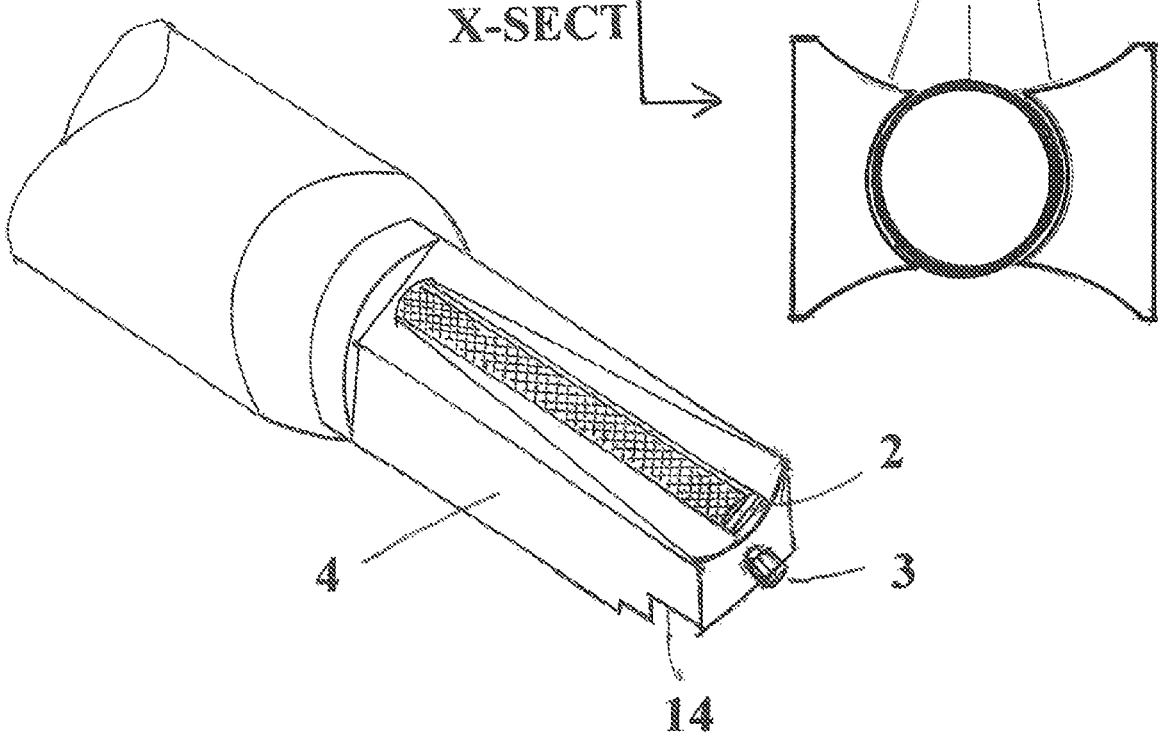
FIG. 5C is a close-up of elevated and angled perspective view of the head portion of the device having two facet planes with a adjustable guard tab 2 and a pair of cove shape groove on a cone shape configuration on top and bottom of the safety guard cap 4. It shows one facet plane without a dynamic nail length filing area and the opposite side facet plane with an open area of dynamic nail length filing area. Also shows cove shape groove, which will stabilize the nail filing finger from inertial movement due to rotating abrasive nail file.
Figure 6:
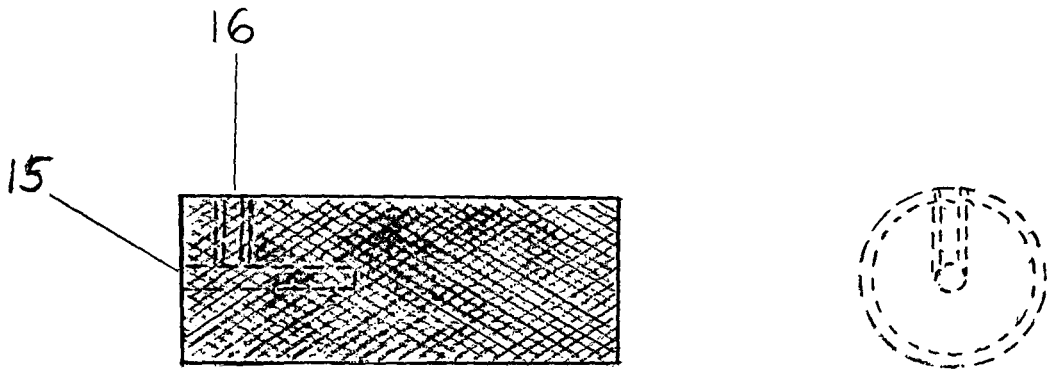
FIG. 6 is an exemplary metallic rotary filing wheel 1, in accordance with an embodiment of the present invention. Materials being chosen are metals and alloys of bronze, brass, stainless steel, aluminum, or copper, including all metals and oxide form of any metals and alloys. Claiming surface roughness of filing wheel is ranging from 100 meshes to 600 meshes, diameter of the filing wheel is ranging from 3 mm to 30 mm, and rotational speed of the filing wheel is ranging from 100 rpm to 15,000 rpm. 15 is a hole for the motor shaft to fit in. 16 is a set screw to hold motor shaft in place.
Figure 7:
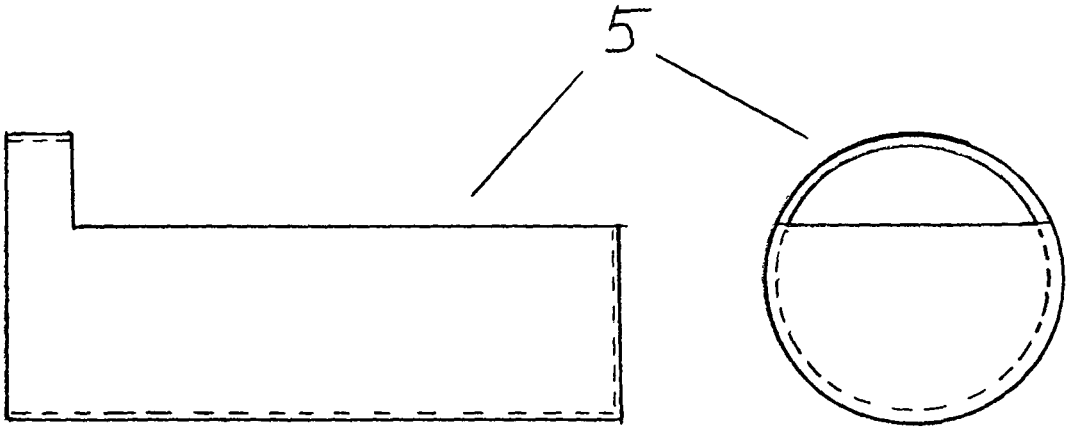
FIG. 7 is a perspective view of the optional nail debris collector 6 of the present invention. It can be made of any thin plastic or metal sheet.
Figure 8:
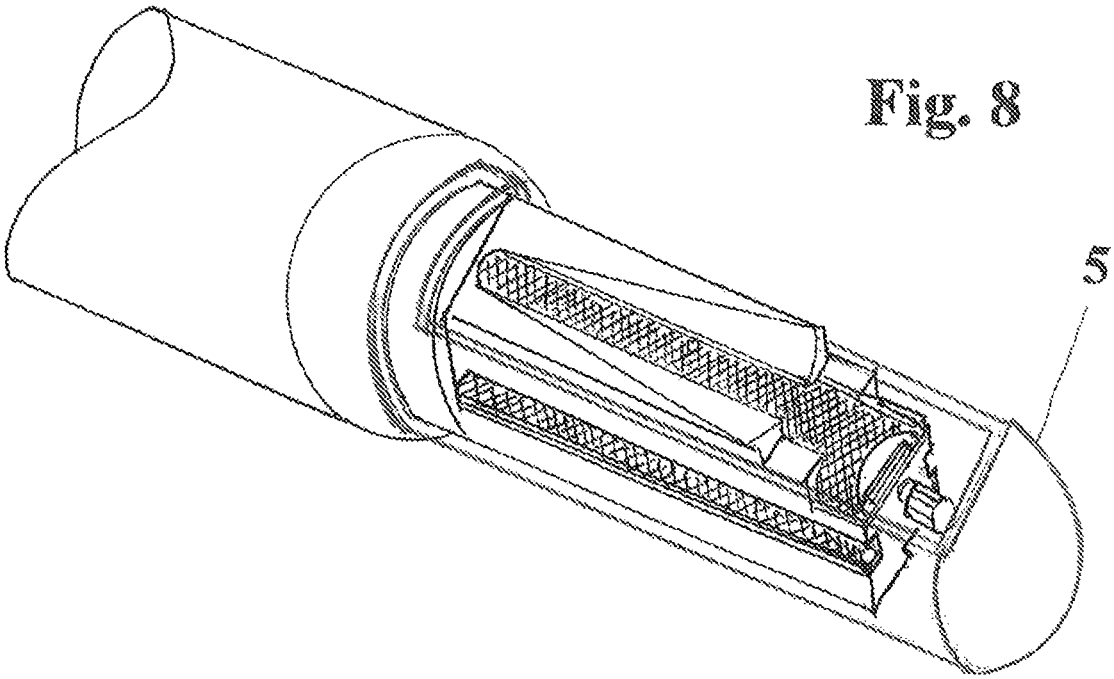
FIG. 8 is a perspective view of the debris collector 5 attached on the nail filing device with the safety guard cap.

Further, one embodiment of the guarding cap member is providing two or more level terraced surface on one or more planes of the safety guard cap 4. FIG. 3 is example of the terraced surface guarding cap. One example of the terraced surface of the safety guard cap 4 is that the safety guard cap 4 has two-step shaped terraced surfaces on the planes of the safety guard cap 4 providing different two depths slot for nail filing for different finger tips. The other example of the terraced surface is that the plane of the safety guard cap 4 provides irregular type terraced surface having three different depths slot.

The other embodiment of the safety guard cap member is purposely making the cylindrical housing inner space radially offsetting to the one direction of the surfaces of the safety guard cap 4, and such that the each thickness of surfaces are different each other. For example, the rectangular prism shaped safety guard cap 4 having offsetting inner space provides four different depth slots. Purposely the offsetting inner space helps each user choosing one depth from multiple different depth surfaces depending on user's shape of fingernails or toenails.

For the alternative electric power for operating the electric motor 6 the present invention provides DC voltage input plug-in hole attached on the cover 9, in which it is connected to the power control circuit having on/off switch and further connected to the electric motor 6. Alternatively the DC voltage input plug-in hole is attached on the cylindrical body 7. The DC voltage power provides more stable electric power to the electric motor 6.

What is claimed is:

1. An electric nail filing device with a safety guard cap, comprising:

a cylindrical body having a battery holder attached inside the cylindrical body;

a cover attached to an open end of the cylindrical body;

an on/off switch attached on the cylindrical body;

a DC voltage input plug on the open end cover;

an electric motor attached on an opposing end of the cylindrical body having a metallic rotary filing wheel;

the safety guard cap which is an attachable or detachable housing member having enough longitudinal length to cover the metallic rotary filing wheel, which is a rectangular prism shape having four plane surface, one open end, and one closed end and has a tubular cylindrical inner space having enough space to cover the metallic rotary filing wheel;

a cove shaped filing slot formed on at least one of the plane surfaces of the safety guard cap, which extends in a direction along the longitudinal axis to the closed end of the safety guard cap;

and an adjustable guard tab member comprising a square-flat plate attached inside of the closed end of the safety guard cap, a slot on a surface of the closed end of the safety guard cap, a threaded bolt attached orthogonally on the square-flat plate, and a turning knob for loosening or tightening the threaded bolt on the square-flat plate.

2. An electric nail filing device in accordance with claim 1, wherein at least one plane surface of the safety guard cap has a pair of longitudinal cove shaped grooves; wherein the pair of longitudinal cove shaped grooves are in a stepped configuration having a slot located on a center line between the pair of longitudinal cove shaped grooves; and a top surface of the metallic rotary filing wheel is slightly elevated above a surface of the lowest cove shaped groove.

3. An electric nail filing device in accordance with claim 1, wherein the longitudinal cove shaped filing slot has a longitudinal cone shape configuration having a gradual widening shape from the open end to the closed end.

4. An electric nail filing device in accordance with claim 1, wherein the safety guard cap is covered by a nail debris collector made of a hard casing material and shaped as a half-dome covering all other planes of the safety guard cap except one plane.

* * * * *